US005408725A

United States Patent [19]

Wolanin

[11] Patent Number: 5,408,725

[45] Date of Patent: Apr. 25, 1995

[54] HINGE ASSEMBLY

[75] Inventor: Gerald L. Wolanin, Galesburg, Ill.

[73] Assignee: Maytag Corporation, Newton, Iowa

[21] Appl. No.: 49,407

[22] Filed: Apr. 20, 1993

[51] Int. Cl.[6] ..... E05D 7/06

[52] U.S. Cl. ..... 16/239

[58] Field of Search ..... 16/239, 240, 242, 243, 16/246, 248, 249, 250, 251, 237, 32, DIG. 43; 312/351.1, 351.11, 351.12, 351.13, 351.3, 351.4, 351.7, 351.8, 401, 405

[56] References Cited

U.S. PATENT DOCUMENTS

| | | | |
|---|---|---|---|
| 318,288 | 5/1885 | Perkins . | |
| 1,949,183 | 2/1934 | Roberts . | |
| 2,975,013 | 3/1961 | Wallace et al. . | |
| 3,290,109 | 12/1966 | Vanegas | 312/405 |
| 3,320,699 | 5/1967 | Carson et al. . | |
| 3,323,163 | 6/1967 | Goodnow . | |
| 4,070,728 | 1/1978 | Herman | 16/243 |
| 4,151,681 | 5/1979 | Roberts . | |
| 4,170,391 | 10/1979 | Bottger | 312/405 |
| 4,570,291 | 2/1986 | Smith et al. | 16/250 |
| 4,856,141 | 8/1989 | Sassenberg | 16/250 |
| 4,932,729 | 6/1990 | Thompson et al. . | |
| 5,215,367 | 6/1993 | Montuoro et al. | 312/401 |

FOREIGN PATENT DOCUMENTS 2501-274 3/1982 France .

*Primary Examiner*—P. Austin Bradley
*Assistant Examiner*—Chuck Y. Mah
*Attorney, Agent, or Firm*—Bacon & Thomas

[57] ABSTRACT

A hinge assembly for the door of a refrigerated cabinet includes a hinge bracket that is secured to a cabinet weld assembly by passing a plurality of fasteners through the bracket and weld assembly and securing the fasteners to a first leg of a substantially L-shaped mounting arm such that the cabinet weld assembly is sandwiched between the first leg and the bracket. The bracket includes a load bearing surface supporting a pivot pin defining a pivot axis for the door. The mounting arm includes a second leg which is arranged at a predetermined angle, preferably ninety degrees, with respect to the first leg thereof. After the bracket is secured to the first mounting leg, the second leg assumes a static position from which it is rotated and is secured to a bottom panel of the cabinet. Rotation of the second leg of the mounting arm creates an inward preload on the cabinet weld assembly and causes a toe-in of the hinge bracket. The door, when pivotally mounted between the lower hinge bracket and an upper hinge bracket secured at the top of the cabinet, is biased upward at its handle side due to having pivoted about the upper hinge. This arrangement prevents the handle side of the door from dropping beyond a perpendicular position due to static and dynamic forces exerted thereon.

20 Claims, 6 Drawing Sheets

138
94
91
27
89
105
87
119
102
106
37
35
-19-
65
75
69
-72-
77
1
70
67
68
8

HINGE ASSEMBLY

BACKGROUND OF THE INVENTION

1. Field of the Invention

The present invention pertains to a hinge assembly and, more particularly, a hinge assembly for pivotally supporting the lower end of an upright refrigerator or freezer door.

2. Discussion of the Prior Art

It is common practice throughout the refrigeration industry to mount a lower door hinge bracket to a channel support leg of a refrigeration cabinet weld assembly by utilizing a flat mounting plate provided with threaded holes. A plurality of fasteners extend through the hinge bracket and the cabinet weld assembly and are threadably received within the holes in the mounting plate. By this arrangement, the cabinet weld assembly is sandwiched between the door hinge bracket and the mounting plate. The hinge bracket is adapted to support a door and carries an upstanding pivot pin about which the door can pivot.

Although this prior art hinge assembly can support static vertical loads, it fails to adequately accommodate side loads exerted thereupon, whether dynamic or static in nature. In practice the lower hinge brackets according to the prior art are initially secured substantially perpendicular to cabinet weld assemblies in order to accommodate the highest possible vertical loads. However, the prior art hinge assemblies have been found to axially twist, for various reasons, thereby resulting in the handle side of the door shifting downwardly.

For example, most refrigeration cabinets, i.e, either refrigerator or freezer units, are provided with door liners which are adapted to store refrigerated articles. These articles can substantially increase the weight of the door and the loads that must be sustained by the lower hinge assembly. These same loads can result in shifting of the door if the hinge assembly cannot withstand the resulting forces which tend to twist the hinge assembly. Even with unloaded doors or doors which are not provided with article storing liners, downward shifting of the doors have been found to occur due to dynamic loads incurred during shipping of the units. Also, there is a trend to make thicker doors so that the refrigeration cabinet can be provided with more insulation and thus be more energy efficient than earlier models. This increased thickness and insulation can significantly add to the weight of the door.

The loads exerted upon the lower hinge bracket can also be transmitted to the cabinet weld assembly itself and result in deformation of the cabinet. In addition, if cabinet flanges of the cabinet weld assembly, at which the lower hinge bracket is secured, are not formed perpendicular to the sides of the cabinet, the hinge assembly could be secured to the cabinet weld assembly in a toe-out position which would also result in shifting of the handle side of the door downwardly.

Shifting of the door in the manner discussed above can result in misalignment of the door within the door opening of the cabinet and could alter the effectiveness of the door seal, thereby reducing the efficiency of the refrigeration unit, Therefore, a need exists in the art for a hinge assembly for use in a refrigeration cabinet or the like which will not only accommodate static vertical loads, but also static and dynamic side loads so as to minimize or prevent associated door drop and cabinet flange deformation.

SUMMARY OF THE INVENTION

It is an object of the present invention to provide a hinge assembly, particularly adapted for pivotally supporting a door of a refrigerated cabinet such as a refrigerator or freezer, having enhanced support characteristics so as to prevent toe-out of the hinge assembly due to static and/or dynamic side load forces exerted thereon.

It is another object of the present invention to provide a door hinge assembly which minimizes or entirely prevents downward shifting of the handle side of the door after assembly.

It is a further object of the invention to provide a hinge assembly for pivotally securing a door to a cabinet weld assembly which will prevent structural deformation, primarily axial twisting, of the weld assembly due to static and/or dynamic side loads exerted on the hinge assembly.

These and other objects of the invention are accomplished by providing a lower hinge assembly for the door of a refrigerated cabinet wherein the hinge assembly includes a hinge bracket that is secured to a cabinet weld assembly by passing a plurality of fasteners through the bracket and weld assembly and securing the fasteners to a first leg of a substantially L-shaped mounting arm such that the cabinet weld assembly is sandwiched between the first leg and the bracket. The bracket includes a load bearing surface carrying a pivot pin defining a lower pivot axis for the door. The mounting arm includes a second leg which is angled with respect to the first leg. After the bracket is secured to the first leg, the second leg assumes an unstressed position from which it is rotated to twist the bracket and cabinet weld assembly, thereby aligning the lower pivot axis and structural deformation preventing. The second leg is then secured to a bottom portion of the cabinet to maintain the position of alignment.

Rotation of the second leg of the mounting arm creates an inward preload or toe-in on the cabinet weld assembly and the hinge bracket. The door, when pivotally mounted between the lower hinge bracket and an upper hinge bracket secured at the top of the cabinet, is biased upward at its handle side due to having pivoted about the upper hinge. This hinge arrangement prevents the handle side of the door from dropping beyond a perpendicular position due to static and dynamic forces exerted thereon during shipping and throughout the useful life of the refrigeration unit.

Further objects, features and advantages of the invention will become more readily apparent from the following detailed description of a preferred embodiment thereof when taken in conjunction with the following drawings wherein like reference numerals refer to corresponding parts in the several views.

DETAILED DESCRIPTION OF A PREFERRED EMBODIMENT

Figure 1:
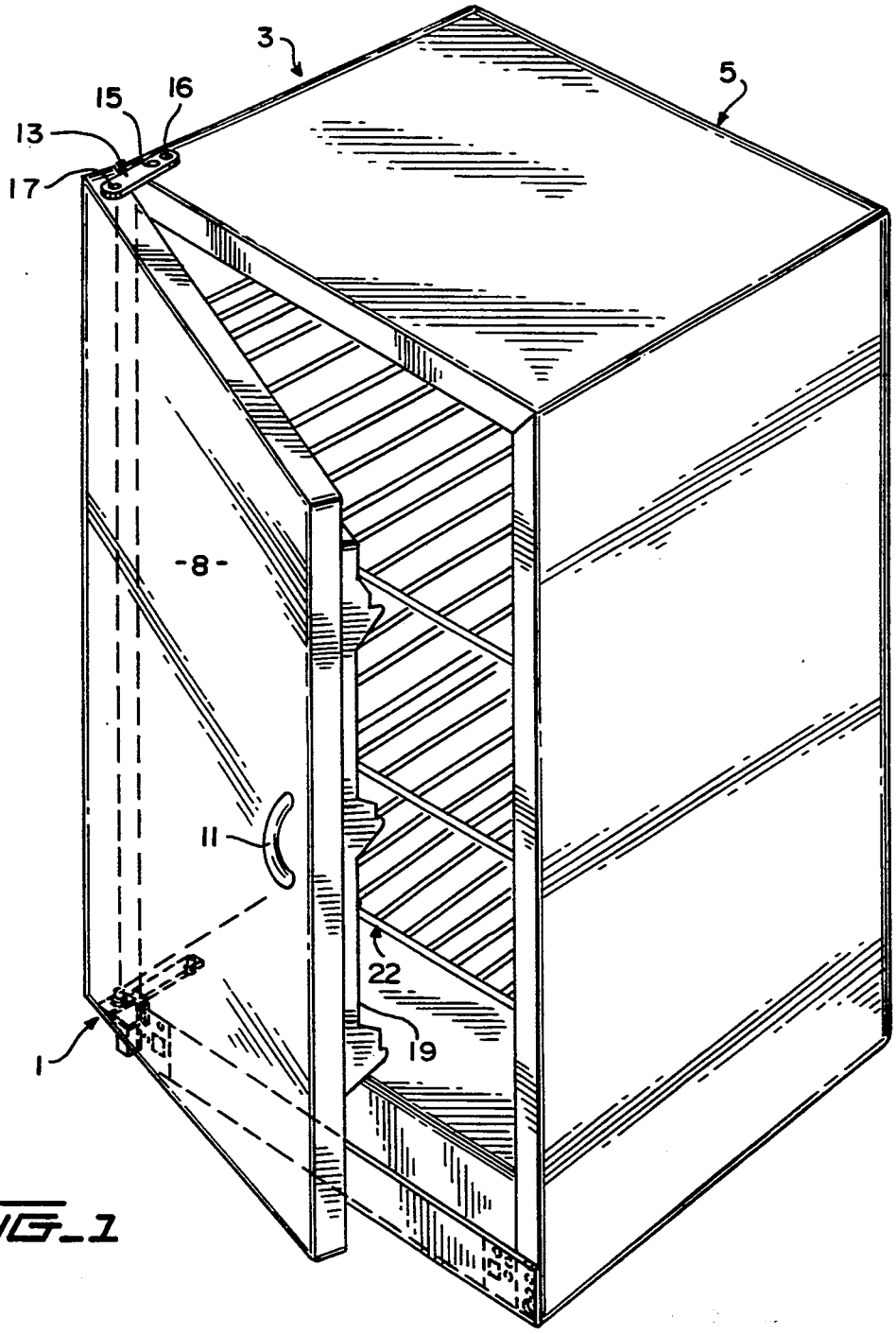
FIG. 1 is a perspective view of a refrigerated cabinet incorporating a first embodiment of the hinge assembly of the present invention.

FIG. 1 depicts a first embodiment of the door hinge assembly 1 of the present invention attached to a refrigerated cabinet 3 including a cabinet body 5 and a door 8. Door 8 includes a handle 11 and is pivotally mounted to cabinet 3 by means of an upper hinge plate 13, which is fastened to cabinet body 5 by fasteners 15 and 16 and includes a pivot pin 17. As depicted, door 8 has fastened thereto an inner liner 19 and cabinet body 5 is provided therein with a plurality of shelves 22. Refrigerated cabinet 3 may comprise a refrigerator, freezer or the like.

Figure 2:
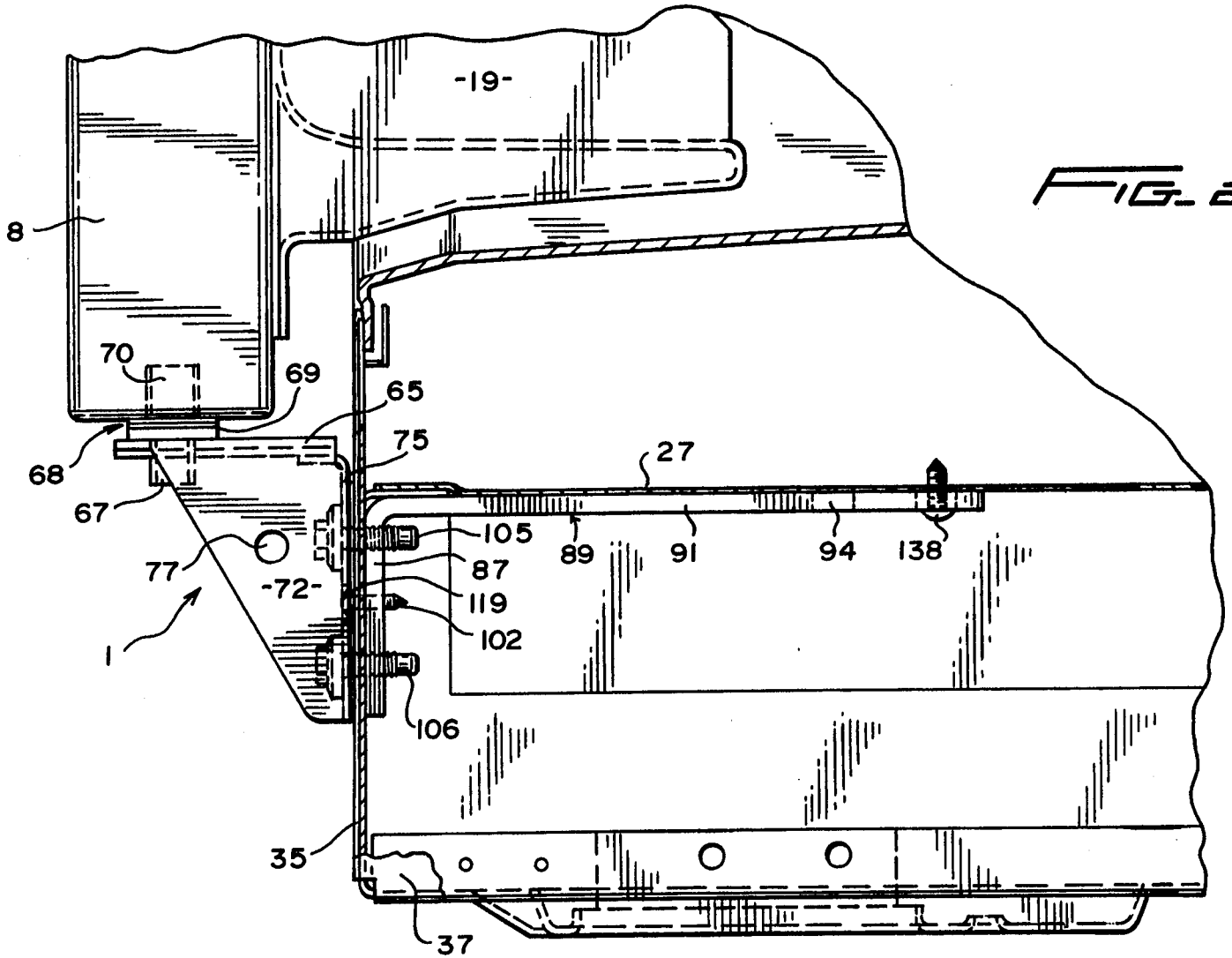
FIG. 2 is a cross-sectional side view of the hinge assembly of FIG. 1 mounted to a flange and channel support leg portion of the cabinet.
Figure 3:
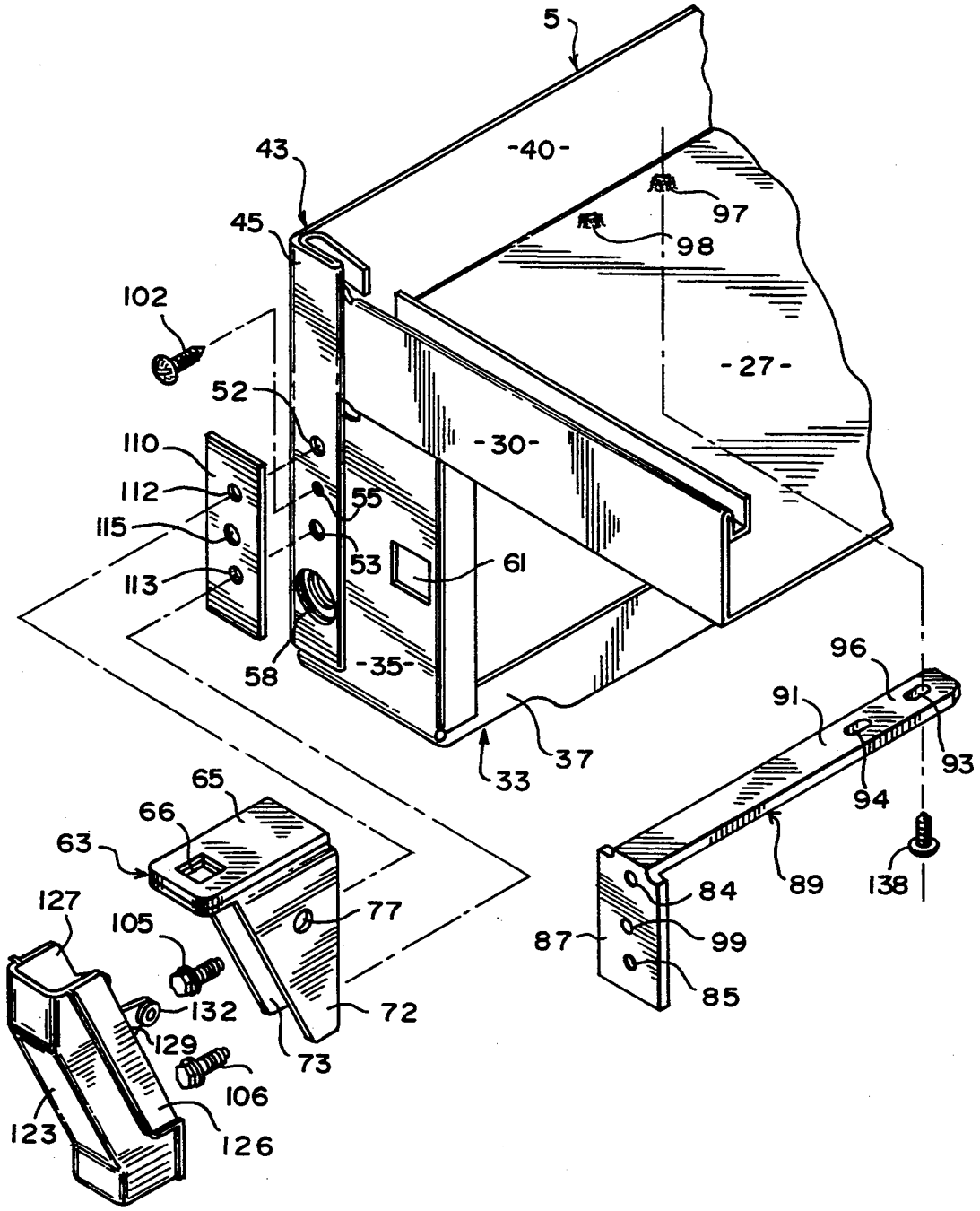
FIG. 3 is an exploded view of the hinge assembly of FIGS. 1 & 2, along with a mounting portion of the cabinet.

With reference to FIGS. 2 and 3, cabinet body 5 includes a substantially horizontal bottom panel 27 which is formed integral with an upstanding front face plate 30, a U-shaped channel support leg 33 including an upright portion 35, a horizontal portion 37, and a side wall 40. As depicted, side wall 40 includes a front zero T-bend corner 43 which defines a cabinet flange 45. Face plate 30, U-shaped channel support leg 33 and flange 45 are fixedly secured together in any manner known in the art, such as spot or resistance welding, and horizontal portion 37 serves as a base for supporting cabinet 3 upon a floor or the like (not shown). Face plate 30, U-shaped channel support leg 33 and flange 45 combine to comprise a cabinet weld assembly as is known in the art.

Flange 45 and upright portion 35 are provided with aligned upper and lower holes 52, 53, preferably having uniform diameters, and a center hole 55 therethrough. In the embodiment shown, center hole 55 has a diameter less than the diameters of holes 52 and 53. Flange 45 and upright portion 35 are also provided with a wire access hole 58 and upright portion 35 includes a square-shaped hole 61 for receiving a snap-type connector of a kick-plate (not shown) in a manner known in the art. It should be recognized that, with the exception of center hole 55, the above-described cabinet structure is known in the art and therefore will not be further discussed in detail.

As shown in FIGS. 2 and 3, door hinge assembly 1 includes a bracket member 63 having an upper load bearing surface 65 provided with a non-circular hole 66 adapted to non-rotatably receive a lower extension 67 of a pivot pin 68. Pivot pin 68 further includes a bearing portion 69 upon which door 8 rests and an upper extension 70 about which, along with pivot pin 17, door 8 may pivot. Bracket member 63 further includes a pair of spaced side walls 72 and 73, along with a rear mounting surface portion 75. Side walls 72 and 73 are provided with aligned through holes, one of which is indicated in side wall 72 at 77. In addition, mounting surface portion 75 includes upper and lower holes (not labeled) which are adapted to be aligned with upper and lower holes 52 and 53 in flange 45, respectively.

Further adapted to be aligned with holes 52 and 53 is a pair of spaced vertical holes 84 and 85 provided in a first upright leg 87 of an L-shaped mounting arm 89. In the embodiment depicted in FIGS. 1–5, holes 84 and 85 are internally threaded. Mounting arm 89 further includes a second leg 91 extending at an angle with respect to first leg 87. In the preferred embodiment, second leg 91 is formed integral with first leg 87 and extends perpendicular therefrom. Second leg 91 is formed with a pair of longitudinally spaced slots 93 and 94 adjacent a free end 96 remote from first leg 87. Slots 93 and 94 are adapted to be aligned with a pair of extruded holes 97 and 98 formed in cabinet bottom 27 as discussed more fully below. First leg 87 is also provided with a central, threaded hole 99 which is adapted to be aligned with center hole 55 extending through flange 45 and upright portion 35 of U-shaped channel support leg 33.

The specific manner in which hinge assembly 1 is attached to U-shaped channel support leg 33 and cabinet flange 45 will now be discussed in detail. Initially, mounting arm 89 is secured to a rear side (not labeled) of upright portion 35 by means of a screw 102 which extends through center hole 55 and is threadably received within central hole 99. Next, bracket member 63 is secured to mounting arm 89, with flange 45 and U-shaped channel support leg 33 therebetween, by means of a pair of screws 105 and 106 which extend through the vertically spaced holes formed in mounting surface portion 75, upper and lower spaced holes 52 and 53, and are threadably received within spaced vertical holes 84 and 85 of first leg 87. In the preferred embodiment, a spacer plate 110, having upper and lower holes 112, 113 and an enlarged central aperture 115, is positioned between bracket member 63 and flange 45 such that screws 105 and 106 also pass through upper and lower holes 112 and 113 with the head (not labeled) of screw 102 positioned within central aperture 115. If the thickness of spacer plate 110 is less than the thickness of the head of screw 102, or if spacer plate 110 is not utilized in the assembly, mounting surface portion 75 of bearing bracket 63 will be formed with a recess 119 to accommodate screw 102 as best shown in FIG. 2.

Once bracket member 63 has been secured to mounting arm 89 in the manner described above, a cover member 123 is adapted to be detachably secured to bracket member 63 to enclose cover screws 105 and 106. Cover member 123 includes a pair of opposing side walls 126, 127 each of which is integrally formed with an extension member 129 having an outwardly projecting tab 132. Only one extension member 129 and its associated tab 132 are depicted in FIG. 3 for simplicity. Extension members 129 are adapted to extend between side walls 72 and 73 of bracket member 63 while flexing toward each other until tabs 132 become aligned with through holes 77. Tabs 132 will then project within holes 77 to removably retain cover member 123 upon bracket member 63.

Figure 4:
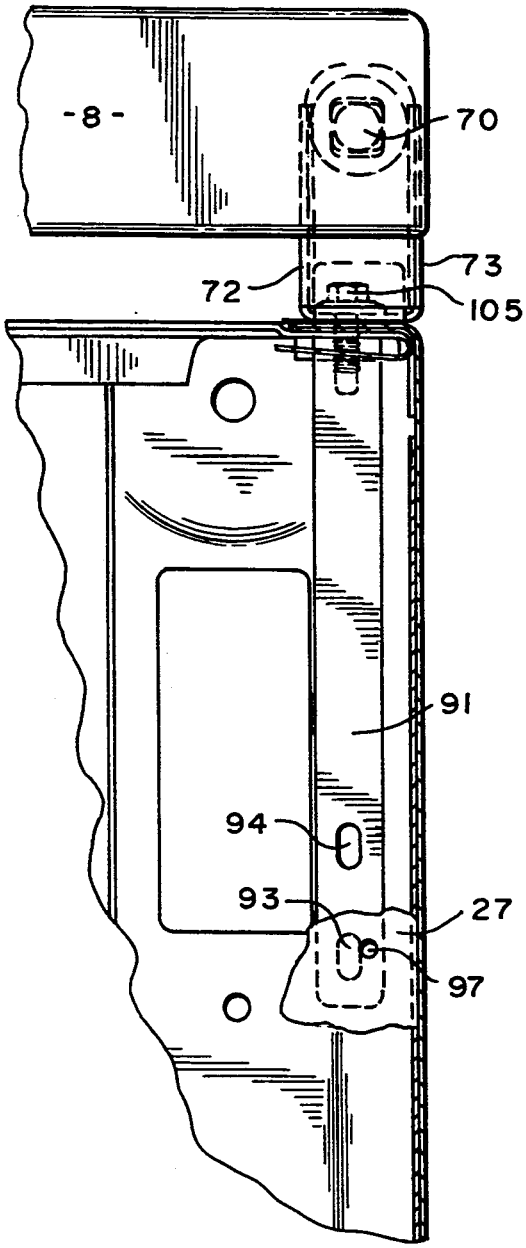
FIG. 4 is a partial top view showing a partially attached condition of the hinge assembly of FIGS. 1–3 to the cabinet.
Figure 5:
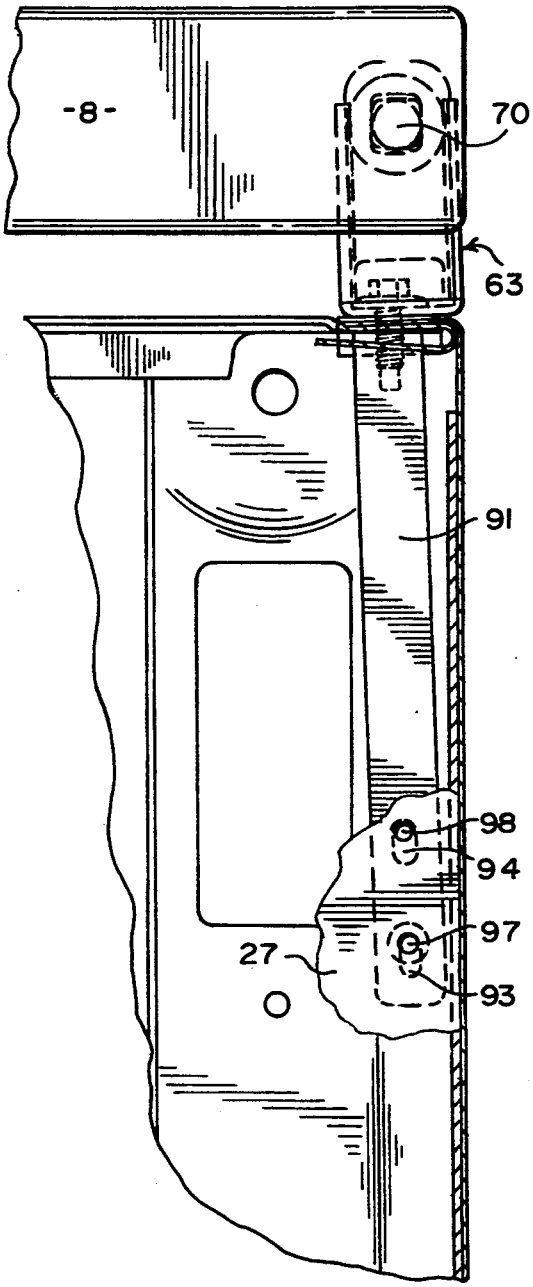
FIG. 5 is a partial top view similar to that shown in FIG. 4, but depicting the hinge assembly in a fully attached condition.

At this point, mounting arm 89 assumes the static position shown in FIG. 4 wherein slot 93 is located offset from extruded hole 97 formed in cabinet bottom panel 27. In the final assembly step of hinge assembly 1 to cabinet body 5, mounting arm 89 is rotated, counterclockwise in the left hand hinge assembly depicted, in order to align slots 93, 94 with extruded holes 97, 98, respectively, as shown in FIG. 5. Rotation of mounting arm 89 creates an inward preload on U-shaped channel support leg 33, cabinet flange 45 and lower hinge bracket member 63 which, in turn, causes a localized slight toe-in effect at the lower hinge assembly 1. Accordingly, since door 8 is mounted upon lower hinge bracket member 63, door 8 will be biased upward at its handle side due to having pivoted about pivot pin 17 of upper hinge plate 13. Screws 138, only one of which is depicted for simplicity in FIG. 3, are then inserted through respective slots 93 and 94 and threaded within extruded holes 97, 98. It is important to note that holes 97 and 98 are formed in cabinet bottom 27 by an extrusion method so as to provide additional surface area for the threading of screws 138. This enables cabinet bottom 27, which is generally formed of sheet metal having a thickness of approximately 20–25/1000 of an inch, to adequately counteract the stress loads placed thereupon.

Figure 6:
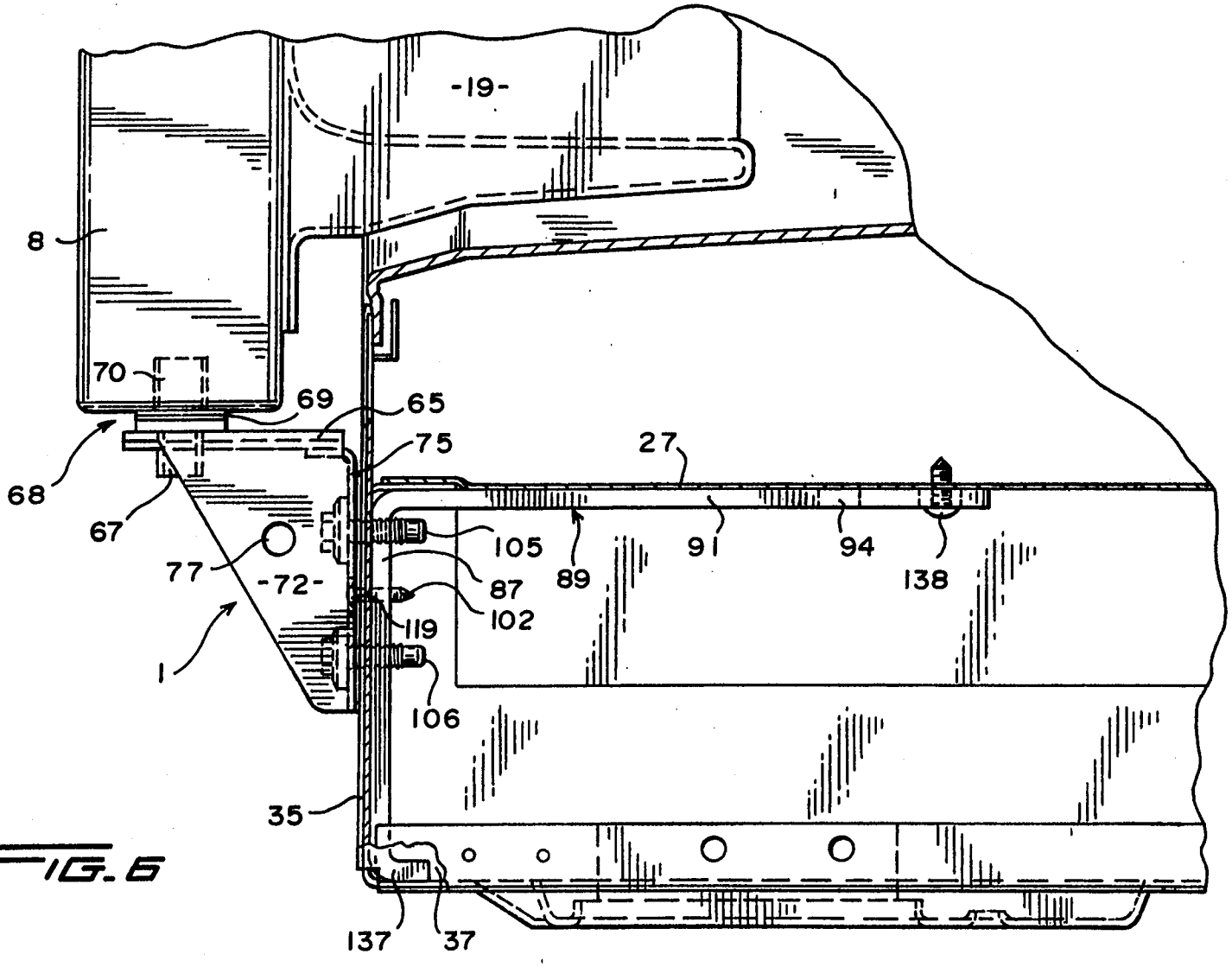
FIG. 6 is a cross-sectional side view similar to that shown in FIG. 2, but of a second embodiment of the hinge assembly of the present invention.
Figure 7:
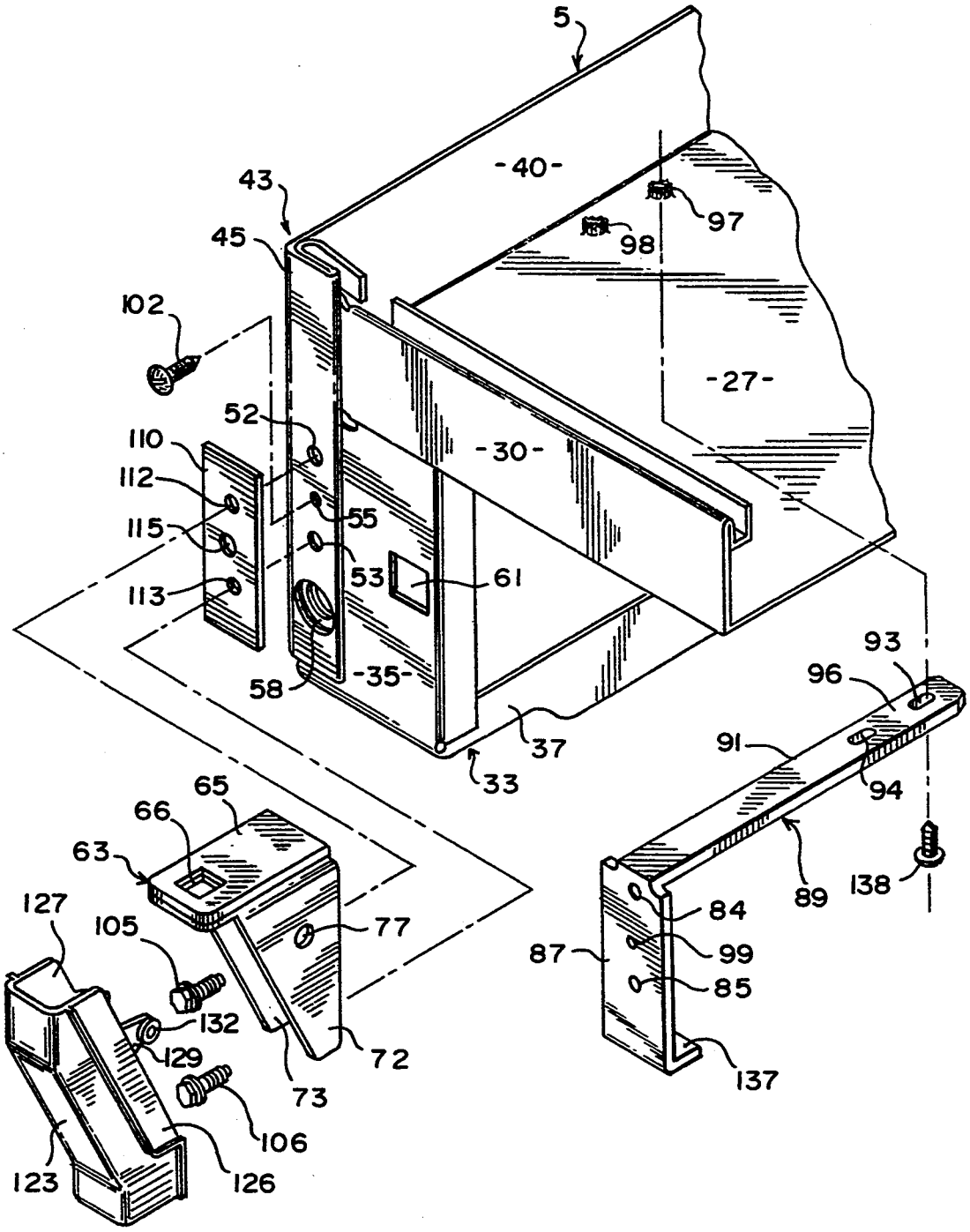
FIG. 7 is an exploded view of the hinge assembly of FIG. 6, along with a mounting portion of the cabinet.

The hinge assembly embodiment depicted in FIGS. 6 and 7 differs from the embodiment in FIGS. 1–5 in that first leg 87 of substantially L-shaped mounting arm 89 is elongated and terminates in an inwardly extending flange 137. Since the remainder of the structure depicted in the embodiment of FIGS. 6 and 7 is identical to that shown in the FIGS. 1–5 embodiment and described above, a duplicate description thereof will not be provided here and it is to be understood that like reference numerals refer to corresponding parts in both of the embodiments. Flange 137 is adapted to rest upon horizontal portion 37 of cabinet body 5. By extending first leg 87 and providing flange 137, the hinge assembly of the second embodiment can resist greater vertical loads as any vertical loads exerted on first leg 87 will be transmitted directly to the support floor through horizontal portion 37. Therefore, hinge assembly 1 according to this embodiment provides additional structural reinforcement and can be used, for example, with doors that are relatively heavy.

As should be recognized from the above description, the hinge assembly 1 according to each of the disclosed embodiments of the present invention preloads bracket member 63 such that door 8 is shifted slightly upward. With this arrangement, it has been found that hinge assembly 1 resists downward shifting of door 8 in response to static axial loads approximately 73% better than conventional lower hinge units. Shipping tests conducted have indicated a significant improvement as well wherein door drop at the handle end was reduced by 68%. The resistance of cabinet flange 45 to twisting was found to be improved by almost 100%.

Although described with respect to preferred embodiments of the invention, it should be readily understood that various changes and/or modifications may be made without departing from the spirit of the invention. For instance, it is not necessary to initially secure mounting arm 89 to U-shaped channel support leg 33 and cabinet flange 45 with screw 102, but rather bracket member 63 and mounting arm 89 can be secured together without the need for screw 102. In addition, as noted above, spacer plate 110 may or may not be utilized without altering the function of the invention. Furthermore, although second leg 91 of mounting arm 89 was indicated to include two attachment slots, only a single slot need be provided to secure mounting arm 89 to cabinet bottom panel 27. Second leg 91 could also be attached to another part of cabinet body 5, such as a flange extending from side wall 40 instead of bottom panel 27. In general, the invention is only intended to be limited by the scope of the following claims.

I claim:

1. A hinge assembly for a door of a refrigerated cabinet comprising:

a cabinet body including a support leg having a substantially vertically extending portion;

a mounting arm including first and second leg portions which are arranged at a predetermined angle to each other;

a bracket member including a load bearing surface portion adapted to support the door for pivotal movement with respect thereto and a mounting surface portion;

first fastener means for fixedly securing the mounting surface of said bracket member to the first leg portion of said mounting arm with the substantially vertically extending portion of the support leg of the cabinet therebetween; and second fastener means for fixedly securing the second leg portion, in a stressed position, to the cabinet at a point offset from an unstressed position of said second leg portion following the securing of said bracket member to said mounting arm so as to apply a preload to the support leg and cause a toe-in of said bracket member.

2. The hinge assembly of claim 1, wherein said mounting arm is substantially L-shaped with said first and second leg portions extending substantially perpendicular to each other.

3. The hinge assembly of claim 1, further including a pivot pin carried by said load bearing surface about which a door can pivot.

4. The hinge assembly of claim 1, wherein the bracket member, the support leg and the first leg portion of the mounting arm include aligned holes and said first fastener means comprises a pair of screws which extend through the aligned holes in the bracket member and support leg and are threadably received in the aligned holes in the first leg portion.

5. The hinge assembly of claim 1, wherein said bracket member includes a pair of spaced side walls interconnecting said load bearing surface portion with said mounting surface portion.

6. The hinge assembly of claim 5, further including a cover member adapted to extend across said spaced side walls and means for releasably securing said cover member to said bracket member.

7. The hinge assembly of claim 1, wherein said cabinet is provided with at least one hole for receiving said second fastener means.

8. The hinge assembly of claim 7, wherein the second leg portion of said mounting arm is provided with at least one slot through which said second fastener means extends.

9. The hinge assembly of claim 8, wherein said at least one hole is extruded in said cabinet and said second fastener means comprises a screw which is threadably received within said at least one hole.

10. The hinge assembly of claim 9, wherein said cabinet includes a bottom panel in which said at least one extruded hole is formed.

11. The hinge assembly of claim 8, wherein the second leg portion of said mounting arm has an axial length that is greater than that of the first leg portion, said at least one slot being formed in the second leg portion at a position remote from said first leg portion.

12. The hinge assembly of claim 1, further including a third fastener means for directly securing the first leg portion of said mounting arm to the support leg of said cabinet.

13. The hinge assembly of claim 12, wherein said third fastener means comprises a screw having an associated head and the mounting surface portion of said bracket member is provided with a recess for receiving said head.

14. The hinge assembly of claim 1, further including a spacer plate fixedly secured by said first fastener means between the mounting surface portion of said bracket member and the support leg of said cabinet.

15. The hinge assembly of claim 1, a flange member carried by and arranged at a predetermined angle with respect to said first leg portion, said flange member being arranged to engage said cabinet body at a position vertically spaced from said second leg portion.

16. A method of securing a door hinge bracket to an upstanding support leg of a refrigerated cabinet through a mounting arm having first and second leg portions which are arranged substantially perpendicular to each other comprising:

securing the door hinge bracket to the first leg portion of said mounting arm with the support leg therebetween;

rotating the second leg portion of said mounting arm so as to cause the door hinge bracket and support leg to twist into a toe-in position; and securing the second leg portion of said mounting arm to the cabinet with the door hinge bracket and support leg in the toe-in position.

17. The method of claim 16, further comprising initially securing a first leg portion of the mounting arm directly to the support leg.

18. The method of claim 16, further comprising locating a spacer plate between the door hinge bracket and the support leg.

19. The method of claim 16, further comprising forming the cabinet with at least one extruded hole and securing the second leg portion of said mounting arm to the cabinet by at least one threaded fastener which extends through the second leg portion and is threadably secured within the at least one extruded hole.

20. The method of claim 16, further comprising removably securing a cover member to the hinge bracket.

* * * * *